US007893912B2

(12) United States Patent
Kim

(10) Patent No.: US 7,893,912 B2
(45) Date of Patent: Feb. 22, 2011

(54) TIMING CONTROLLER FOR LIQUID CRYSTAL DISPLAY

(75) Inventor: MyeongSu Kim, Mokcheon-eup (KR)

(73) Assignee: Samsung Electronics Co., Ltd. (KR)

( * ) Notice: Subject to any disclaimer, the term of this patent is extended or adjusted under 35 U.S.C. 154(b) by 970 days.

(21) Appl. No.: 11/655,621

(22) Filed: Jan. 19, 2007

(65) Prior Publication Data

US 2007/0164969 A1 Jul. 19, 2007

(30) Foreign Application Priority Data

Feb. 7, 2006 (KR) ..... 10-2006-0011848

(51) Int. Cl.
*G09G 3/36* (2006.01)

(52) U.S. Cl. ..... 345/99; 345/98

(58) Field of Classification Search ..... None
See application file for complete search history.

(56) References Cited

U.S. PATENT DOCUMENTS 6,483,447 B1 * 11/2002 Eglit ..... 341/111

* cited by examiner

*Primary Examiner*—Alexander Eisen
*Assistant Examiner*—Robin Mishler
(74) *Attorney, Agent, or Firm*—Innovation Counsel LLP

(57) ABSTRACT

A timing controller for a liquid crystal display device includes an error detection module that detects an error in signals input from an external source and generates a data signal based on the error in the signals, so as to display the data signal on a liquid crystal panel for a predetermined time period. Thus, the liquid crystal display device stably displays the data signal while compensating for the error in the input signals, thereby improving the image quality of the liquid crystal display device.

22 Claims, 5 Drawing Sheets

TIMING CONTROLLER FOR LIQUID CRYSTAL DISPLAY

CROSS-REFERENCE TO RELATED APPLICATION

This application relies for priority upon Korean Patent Application No. 2006-11848 filed on Feb. 7, 2006, the contents of which are herein incorporated by reference in its entirety.

FIELD OF THE INVENTION

The present invention relates to a liquid crystal display device and, more particularly, to a timing controller capable of detecting an error in an input signal.

DESCRIPTION OF THE RELATED ART

Together with display devices employing cathode ray tubes, liquid crystal display devices occupy an important position in the field of image display devices. The liquid crystal display device includes two separated substrates with a liquid crystal layer between them. The liquid crystal display device applies an electric field to the liquid crystal panel by varying the applied electric field to control the transmittance of light passing through the liquid crystal layer. If the image data signal and the control signal, which are input into the liquid crystal display device from the external graphic source are not suitable the image quality of the liquid crystal display device is affected.

SUMMARY OF THE INVENTION

The present invention provides a timing controller capable of improving an image quality of a liquid crystal display device. In one aspect of the present invention, a timing controller includes a clock generator, an error detector, a data generator, a first multiplexer, a second multiplexer, and a signal generator. The clock generator generates a first clock signal in response to an external signal. The error detector receives a second clock signal and an external data enable signal and outputs a detection signal based on detecting an error in the second clock signal and the data enable signal. The data generator generates a first data signal corresponding to the detection signal. The first multiplexer selectively outputs the first clock signal or the second clock signal in response to the detection signal. The second multiplexer selectively outputs the first data signal or a second data signal, which is input from an external source, in response to the detection signal. The signal generator generates a data signal and a control signal in response to signals output from the first and second multiplexers.

In another aspect of the present invention, a method of driving the timing controller is provided as follows. First, a first clock signal is generated by receiving a voltage from an external source and a detection signal is output based on an error in a second clock signal and a data enable signal received from an external source. Then, a first data signal corresponding to the detection signal is generated. In addition, the first clock signal or the second clock signal is selectively output in response to the detection signal, and the first data signal or a second data signal, which is input from an external source, is selectively output in response to the detection signal. After that, a data signal and a control signal are generated in response to the first or second clock signal, and the first or second data signal, respectively.

In still another aspect of the present invention, a liquid crystal display device includes a liquid crystal panel, a timing controller and a driving module. The liquid crystal panel displays an image in response to a driving signal. The timing controller receives a first clock signal and a data enable signal from an external source to output a detection signal based on an error in the first clock signal and the data enable signal. The timing controller outputs a data signal and a control signal corresponding to the detection signal while maintaining the detection signal for a predetermined time period. The driving module outputs a driving signal to drive the liquid crystal panel in response to the data signal and the control signal.

According to the above, the timing controller detects the error in the image signals, which are input into the timing controller from the external source, and then generates the data signal compensating for the input signal having the error, so that the data signal suitable for the liquid crystal panel can be stably displayed. Thus, the image quality of the liquid crystal display device can be improved.

BRIEF DESCRIPTION OF THE DRAWING

The above and other advantages of the present invention may become more apparent from a reading of the ensuing description together with the drawing, in which.

DESCRIPTION OF THE EMBODIMENTS

Figure 1:
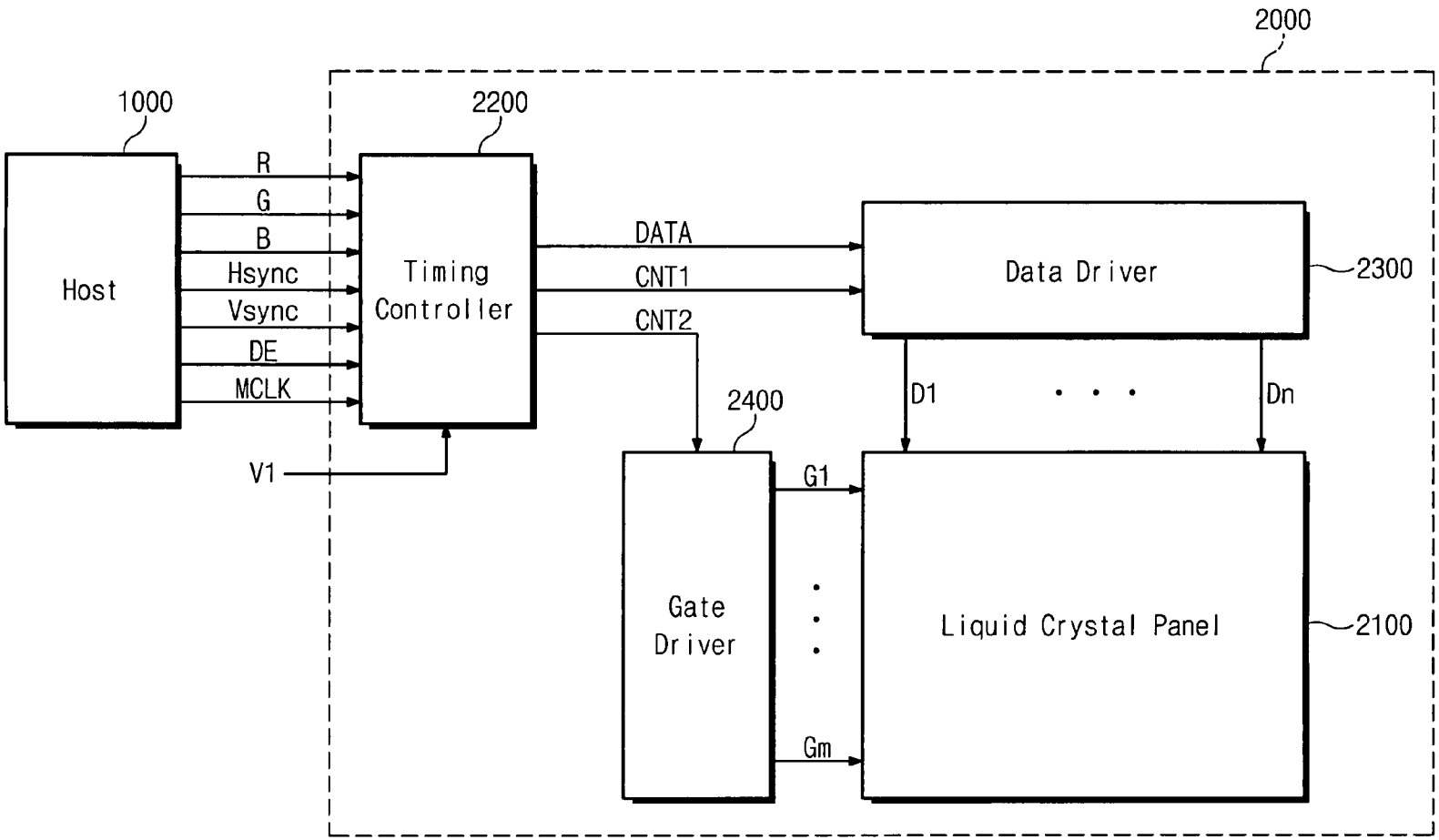
FIG. 1 is a block diagram showing a display system according to an exemplary embodiment of the present invention.

Referring to FIG. 1, the display system includes a host 1000 providing image data signals RGB and control signals such as a horizontal synchronous signal Hsync, a vertical synchronous signal Vsync, a data enable signal DE and a main clock signal MCLK to a liquid crystal display device 2000. Host 1000 includes a graphic card used for a computer and provides the image data signals RGB to be displayed on liquid crystal display device 2000. The image data signals RGB and the control signals Hsync, Vsync, DE and MCLK are transmitted between host 1000 and liquid crystal display device 2000 through a low voltage differential signal (LVDS) interface or a transistor-to-transistor logic (TTL) interface.

Liquid crystal display device 2000 includes a liquid crystal panel 2100 displaying the images, a timing controller 2200 generating control signals, a data driver 2300 outputting data line driving signals, and a gate driver 2400 outputting gate line driving signals.

Liquid crystal panel 2100 includes a first substrate having pixel electrodes, a second substrate facing the first substrate, and liquid crystal injected between the two substrates. One of the substrate includes pixel electrodes formed with gate lines and data lines that cross each other at predetermined intervals forming a matrix pattern.

Timing controller 2200 receives the horizontal synch signal Hsync, the vertical synch signal Vsync, the main clock signal MCLK, the data enable signal DE and image data signals RGB from host 1000. Timing controller 2200 receives a voltage signal VI from an external source so as to generate an internal clock signal. Timing controller 2200 outputs data signals DATA by converting the format of the image data signals RGB so as to correspond to the standard employed by the liquid crystal panel. Timing controller 2200 also outputs first and second control signals CNT1 and CNT2. The data signal DATA and the first control signal CNT1 are applied to data driver 2300 and the second control signal CNT2 is applied to gate driver 2400.

Timing controller 2200 can determine whether the image data signals RGB and the control signals Hsync, Vsync, DE and MCLK output from host 1000 are suitable for the standard employed by liquid crystal display device 2000. When unsuitable data signals are detected, timing controller 2200 does not directly display the abnormal image signal on liquid crystal panel 2100, but creates a new image signal that can be displayed. The error detection function of timing controller 2200 with respect to the input signal will be described later in more detail with reference to FIG. 2.

Data driver 2300 outputs data line driving signals to data lines D1~Dn of liquid crystal panel 2100 in response to data signal DATA and the first control signal CNT1 applied thereto from timing controller 2200. The data line driving signals serve as data voltage applied to the pixels of the liquid crystal panel 2100.

Gate driver 2400 outputs gate line driving signals to gate lines G1~Gm of the liquid crystal panel 2100 in response to the second control signal CNT2 applied thereto from timing controller 2200. The gate line driving signals serve as gate-on voltages or gate-off voltages used to turn on or turn off the thin film transistors of liquid crystal panel 2100.

Figure 2:
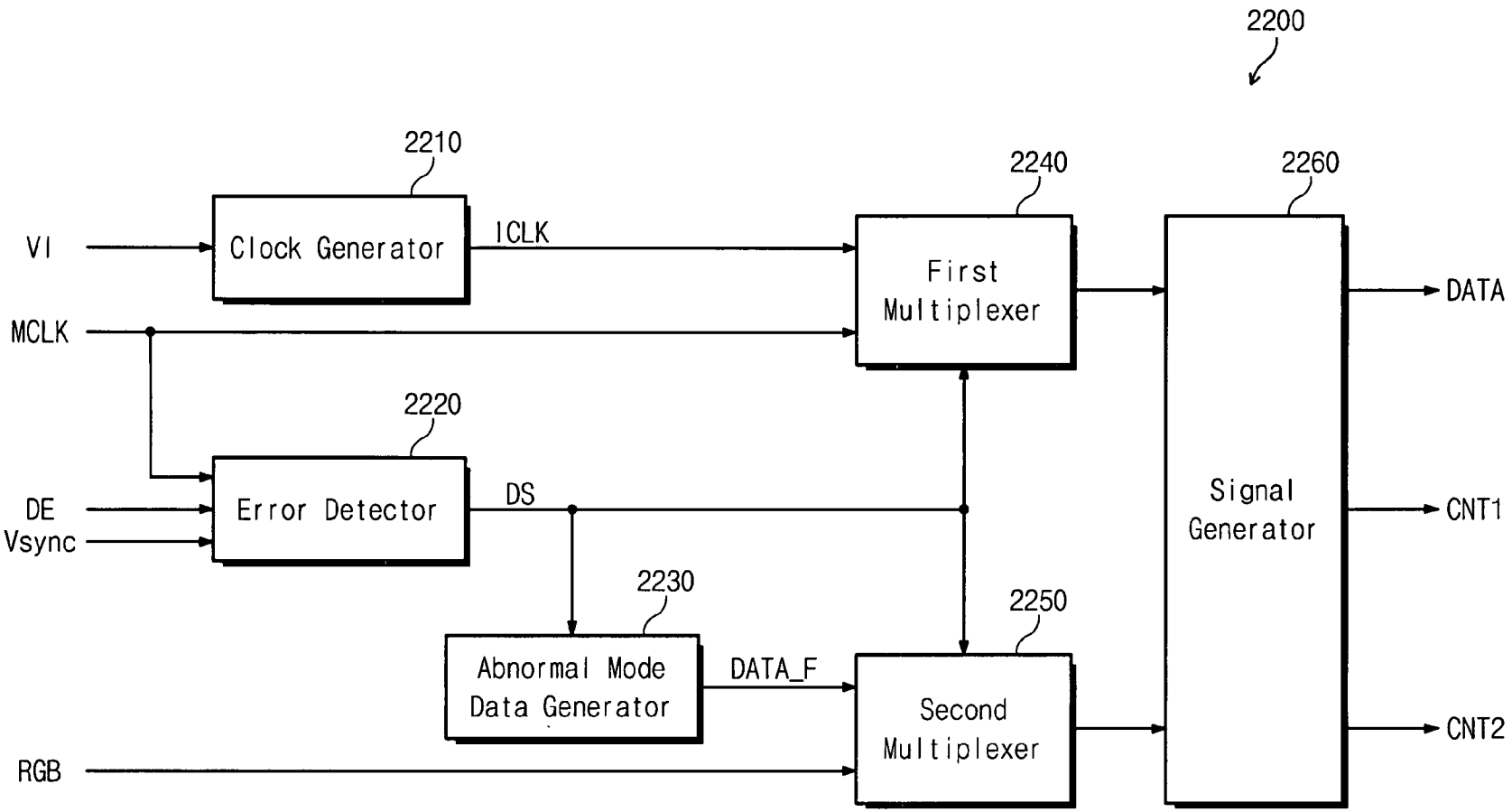
FIG. 2 is a block diagram of a timing controller shown in FIG. 1.

FIG. 2 is a block diagram of the timing controller shown in FIG. 1.

Referring to FIG. 2, timing controller 2200 includes a clock generator 2210 generating a clock signal, an error detector 2220 detecting an error in an input signal, an abnormal mode data generator 2230, a first multiplexer 2240, a second multiplexer 2250, and a signal generator 2260.

Clock generator 2210 receives a voltage signal VI from an external source so as to continuously output an internal clock signal ICLK having a predetermined frequency. The internal clock signal ICLK serves as a reference clock signal for timing controller 2200 when an abnormal signal is input from host 1000. If a normal signal is input into timing controller 2200, main clock signal MCLK serves as the reference clock signal.

Internal clock signal ICLK output from clock generator 2210 is applied to the first multiplexer 2240. Clock generator 2210 includes an inegrated circuit ring oscillator.

Error detector 2220 receives the main clock signal MCLK, data enable signal DE, and vertical synch signal Vsync from host 1000 and then checks for an error in the signals from host 1000 to output a detection signal DS based on an error in the signals. Signal DS is applied to the abnormal mode data generator 2230 and to first and second multiplexers 2240 and 2250.

Detection signal DS is maintained in an active state for a predetermined time period when the abnormal signal is input and is maintained in an inactive state when a normal signal is input into timing controller 2200.

The abnormal mode data generator 2230 outputs an abnormal mode data signal DATA_F. In contrast, if the detection signal DS in the inactive state is input into the abnormal mode data generator 2230 from the error detector 2220, the abnormal mode data generator 2230 does not operate. The abnormal mode data signal DATA_F output from abnormal mode data generator 2230 is applied to second multiplexer 2250. In the present embodiment, the abnormal mode data signal DATA_F represents an image having a predetermined color, such as black or white.

First multiplexer 2240 receives the internal clock signal ICLK from clock generator 2210 and the main clock signal MCLK from host 1000. First multiplexer 2240 selectively outputs the internal clock signal ICLK or the main clock signal MCLK in response to the detection signal DS.

Responsive to the detection signal DS in the active state from the error detector 2220, first multiplexer 2240 transfers the internal clock signal ICLK of clock generator 2210 to signal generator 2260. In contrast, if the detection signal DS in the inactive state is input into the first multiplexer 2240 from the error detector 2220, first multiplexer 2240 transfers the main clock signal MCLK to the signal generator 2260.

Second multiplexer 2250 receives the abnormal mode data signal DATA_F from abnormal mode data generator 2230 and receives the image data signals RGB from host 1000. The second multiplexer 2250 selectively outputs the abnormal mode data signal DATA_F or the image data signal RGB in response to the detection signal DS.

Upon receiving the detection signal DS in the active state from error detector 2220, second multiplexer 2250 transfers the abnormal mode data signal DATA_F to signal generator 2260. In contrast, if the detection signal DS in the inactive state is input into the second multiplexer 2250 from the error detector 2220, second multiplexer 2250 transfers the image data signal RGB to the signal generator 2260.

Signal generator 2260 outputs data signal DATA, the first control signal CNT1 and the second control signal CNT2 in response to the signals that are input from first and second multiplexers 2240 and 2250. Data signal DATA and first control signal CNT1 of the signal generator 2260 are applied to data driver 2300 and second control signal CNT2 is applied to gate driver 2400.

When error detector 2220 outputs the detection signal DS in the active state, signal generator 2260 receives the internal clock signal ICLK from first multiplexer 2240 and receives the abnormal mode data signal DATA_F from second multiplexer 2250. On the contrary, when the error detector 2220 outputs the detection signal DS in the inactive state, the signal generator 2260 receives the main clock signal MCLK from first multiplexer 2240 and receives the image data signals RGB from e second multiplexer 2250.

Figure 3:
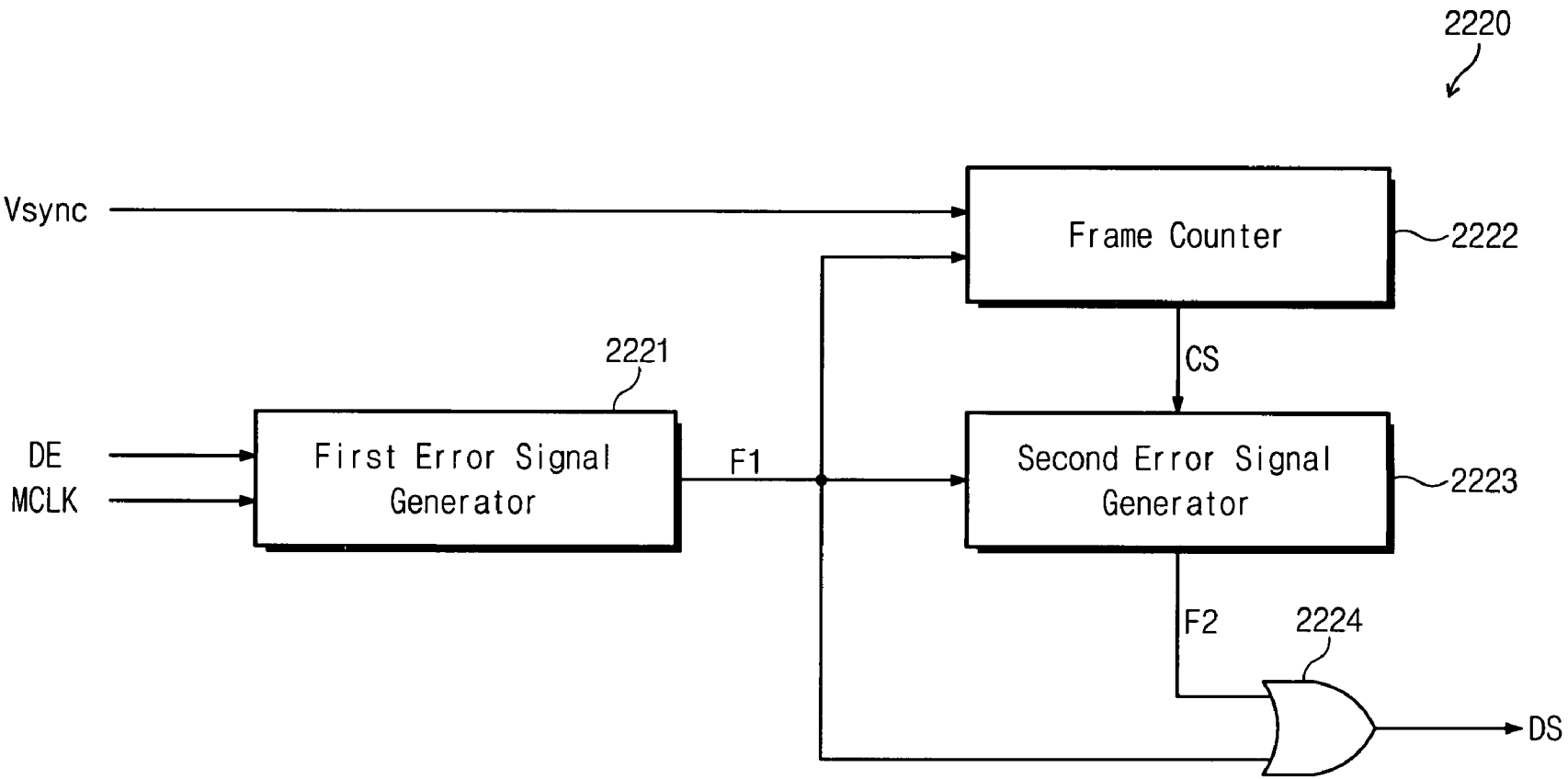
FIG. 3 is a block diagram of an error detector shown in FIG. 2.

FIG. 3 is a block diagram of the error detector shown in FIG. 2. Referring to FIG. 3, error detector 2220 includes a first error signal generator 2221, a frame counter 2222, a second error signal generator 2223, and an OR logic circuit 2224. The first error signal generator 2221 receives the main clock signal MCLK and the data enable signal DE from host 1000, and then outputs a first detection signal F1 based on the error in the main clock signal MCLK and the data enable signal DE. The first error signal generator 2221 applies the first detection signal F1 to frame counter 2222, t second error signal generator 2223, and OR logic circuit 2224.

Figure 4A:
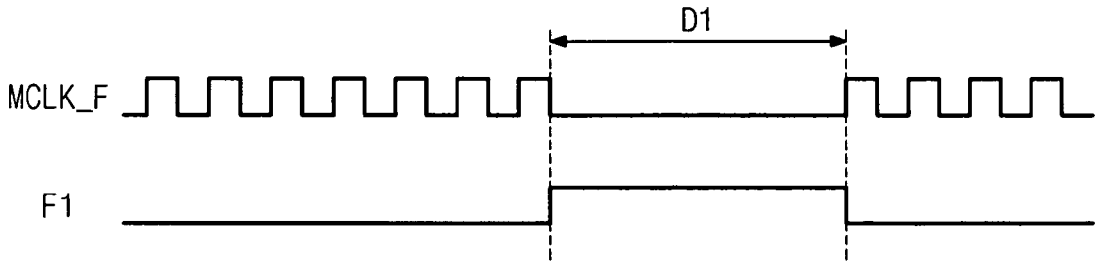
FIGS. 4A and 4B are waveform diagrams of signals generated from a first error signal generator shown in FIG. 3.
Figure 4B:
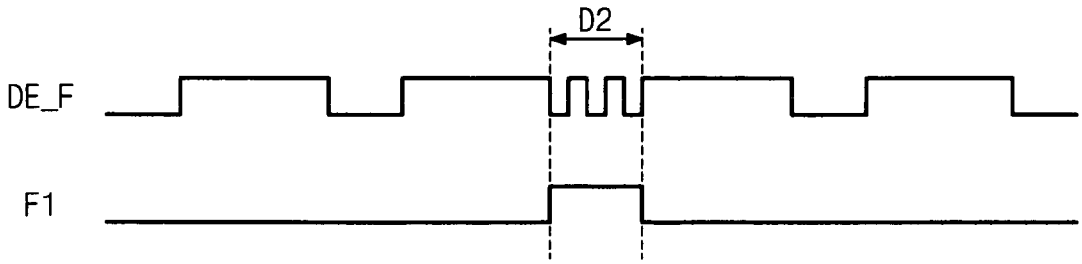

FIGS. 4A and 4B are waveform diagrams of signals generated from the first error signal generator shown in FIG. 3. FIG. 4A represents the waveform of the first detection signal F1 output from first error signal generator 2221 when an abnormal main clock signal MCLK_F is input into timing controller 2200 from host 1000, and FIG. 4B represents the waveform of the first detection signal F1 output from the first error signal generator 2221 when an abnormal data enable signal DE_F is input into timing controller 2200 from host 1000.

Referring to FIG. 4A, if an abnormal main clock signal MCLK_F is input into timing controller 2200 from host 1000, first error signal generator 2221 outputs signal F1, which is activated for a first period D1 during which the abnormal main clock signal MCLK_F is input. First error signal generator 2221 regards the main clock signal MCLK of host 1000 as an abnormal main clock signal MCLK_F if the main clock signal MCLK is maintained in a high level or a low level without being toggled for a predetermined time period.

Referring to FIG. 4B, if an abnormal data enable signal DE_F is input into timing controller 2200 from host 1000, the first error signal generator 2221 outputs the first detection signal F1, which is activated for a second period D2 during which the abnormal data enable signal DE_F is input.

First error signal generator 2221 regards the data enable signal DE of host 1000 as an abnormal data enable signal DE_F if the period of the data enable signal DE does not match with a predetermined reference period, or the number of activations of the data enable signal DE does not match with a predetermined reference number. Here, since the data enable signal DE is activated in a line unit of the image data signal RGB, the number of activations of the data enable signal DE from host 1000 may correspond to the line number of the image data signal RGB.

Frame counter 2222 counts the number of frames in the image data signal RGB, which is input from host 1000, in response to the vertical synchronous signal Vsync of host 1000 and the first detection signal F1 of first error signal generator 2221, and then outputs a counting signal CS. Frame counter 2222 applies the counting signal CS to second error signal generator 2223.

Frame counter 2222 starts to count the frame number of the image data signal RGB as the first detection signal F1 input from the first error signal generator 2221 is shifted into the active state or the inactive state. The vertical synch signal Vsync of host 1000 serves as a reference signal when frame counter 2222 counts the frame number of the image data signal RGB, generating one active signal for each frame unit of image data signal RGB.

After counting the frame number until it reaches a predetermined number, frame counter 2222 outputs the counting signal CS. The counting signal CS is reset as the first detection signal F1 is shifted into the active state or the inactive state, so that the frame counter 2222 counts the number of frames until it reaches a predetermined frame number.

For instance, let it be assumed that frame counter 2222 outputs counting signal CS after it counts three frames. Frame counter 2222 starts to count the frames on the basis of the vertical synch signal Vsync as the first detection signal F1 is shifted into the active state. Then, frame counter 2222 outputs the counting signal CS after it has counted the three frames. Otherwise, frame counter 2222 starts to count the frames on the basis of the vertical synch signal Vsync as the first detection signal F1 is shifted into the inactive state and outputs the counting signal CS after it has counted the three frames.

Second error signal generator 2223 outputs a second detection signal F2 in response to the first detection signal F1 from first error signal generator 2221 and the counting signal CS from frame counter 2222. The second error signal generator 2223 applies the second detection signal F2 to OR circuit 2224.

Second error signal generator 2223 delays the first detection signal F1 in response to the counting signal CS to output the second detection signal F2. For instance, second error signal generator 2223 outputs the second detection signal F2 by delaying the first detection signal F1 until the counting signal CS has been output from frame counter 2222.

OR logic circuit 2224 ORs the first detection signal F1 from the first error signal generator 2221 and the second detection signal F2 from the second error generator 2223, thereby generating the detection signal DS.

Figure 5:
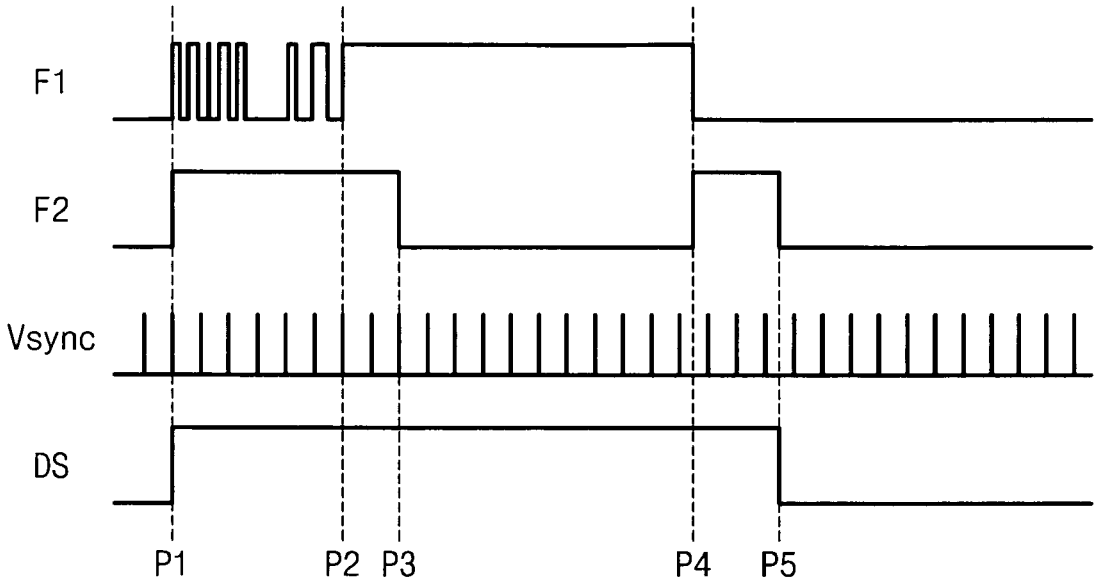
FIG. 5 is a waveforms diagram of signals generated from the error detector shown in FIG. 3.

FIG. 5 is a waveforms diagram of signals generated from the error detector shown in FIG. 3. Referring to FIG. 5, the first detection signal F1 output from first error signal generator 2221 has active periods (high level periods) and inactive periods (low level periods), which may repeat in a range between a first point P1 and a fourth point P4. Since the first detection signal F1 is generated based on the error in the signals that are input into timing controller 2200 from host 1000, it can be understood from the first detection signal F1 that the normal signal and the abnormal signal are alternately input into timing controller 2200 from host 1000 in the range between the first point P1 and the fourth point P4.

If timing controller 2200 employs the first detection signal F1 as the detection signal DS without separately creating a detection signal DS, black and white images corresponding to normal and abnormal images are repeatedly displayed on the liquid crystal panel 2100, thereby causing deterioration of the image quality of liquid crystal display device 2000. In order to prevent the deterioration of the image quality, timing controller 2200 generates the detection signal DS separately from the first detection signal F1.

As the first detection signal F1 in the active state is output from the first error signal generator 2221, the second error signal generator 2223 outputs the second detection signal F2. Since the first detection signal F1 is repeatedly shifted between the active period and the inactive period in the period between the first point P1 and the second point P2 before the frame counter 2222 has counted three frames, the second detection signal F2 is maintained in the active state in the period between the first point P1 and the second point P2. When the first detection signal F1 is shifted into the active state, the second detection signal F2 is shifted into the inactive state at the third point P3 after the frame counter 2222 has counted three frames from the second point P2 because the first detection signal F1 is maintained in the active state over three frames.

At the fourth point P4 where the first detection signal F1 is shifted into the inactive state from the active state, the second detection signal F2 is again shifted into the active state. After that, the second detection signal F2 is shifted into the inactive state at the fifth point P5 after the frame counter 2222 has counted three frames from the fourth point P4 because the first detection signal F1 is maintained in the inactive state over the three frames. In other words, when the first detection signal F1 is maintained in the inactive state over three frames it means that the main clock signal MCLK and the data enable signal DE being applied to timing controller 2200 are in the normal state, so that the second detection signal F2 is not necessary to maintain the active state.

That is, the second error signal generator 2223 outputs the second detection signal F2 in the active state for three frames as the first detection signal F1 starts to shift from the active state to the inactive state, or vice versa. In addition, the second detection signal F2 output from the second error signal generator 2223 is shifted into the inactive state after the frame counter 2222 has counted three frames from the inactivation point P4 of the first detection signal F1.

OR logic circuit 2224 ORs the first detection signal F1 and the second detection signal F2, thereby outputting the detection signal DS. Accordingly, the detection signal DS is maintained in the active state between the first point P1 and the fifth point P5, and then is shifted into the inactive state at the fifth point P5. In other words, the black image or the white image corresponding to the abnormal mode image is continuously displayed on the liquid crystal panel 2100 in the period between the first point P1 and the fifth point P5 where the detection signal DS is activated.

Although it has been described that the frame counter 2222 counts three frames in cooperation with the second error signal generator 223, this is for illustrative purpose only and the number of frames counted by the frame counter 2222 can be changed variously.

As described above, timing controller 2200 of liquid crystal display device 2000 detects an error in the signals that are input from the external host 1000. Also, timing controller 2200 generates a data signal compensating for the input signal having the error, thereby displaying the data signal on the liquid crystal panel for a predetermined time period. Accordingly, liquid crystal display device 2000 can stably display the data signal even if the input signal applied to timing controller 2200 has the error, so that the image quality of the liquid crystal display device is improved.

Although the exemplary embodiments of the present invention have been described, it is understood that the present invention should not be limited to these exemplary embodiments but various changes and modifications can be made by one of ordinary skilled in the art within the spirit and scope of the present invention.

What is claimed is:

1. A timing controller for a unit displaying frames of image data in response to a main clock signal and a data enable signal, the timing controller comprising an error detector outputting a detection signal, wherein the error detector comprises:

a first detector outputting a first detection signal in response to the main clock signal and the data enable signal;

a frame counter counting a number of frames in response to the first detection signal and a vertical synchronous signal supplied from an exterior as the first detection signal is generated to output a counting signal;

a second detector delaying the first detection signal for a predetermined time period to output a second detection signal in response to the counting signal; and an OR logic circuit which performs a logical OR of the first detection signal and the second detection signal to output the detection signal.

2. The timing controller of claim 1, wherein the error detector outputs the detection signal which is activated during a time when the main clock signal is in an abnormal state.

3. The timing controller of claim 1, wherein the error detector outputs the detection signal which is activated during a time when the data enable signal is in an abnormal state.

4. The timing controller of claim 1 further comprising:

an abnormal image generator outputting abnormal mode image data having a predetermined color in response to the detection signal.

5. A timing controller comprising:

a clock generator receiving a voltage from an external source to generate a first clock signal;

an error detector receiving a second clock signal and a data enable signal from an exterior to output a detection signal based on an error in the second clock signal and the data enable signal;

a data generator generating a first data signal corresponding to the detection signal;

a first multiplexer selectively outputting the first clock signal or the second clock signal in response to the detection signal;

a second multiplexer selectively outputting the first data signal or a second data signal, which is input from an exterior, in response to the detection signal; and a signal generator generating a data signal and a control signal in response to signals output from the first and second multiplexers.

6. The timing controller of claim 5, wherein the clock generator comprises a ring oscillator.

7. The timing controller of claim 5, wherein the error detector comprises:

a first detector outputting a first detection signal in response to the second clock signal and the data enable signal;

a frame counter counting a number of frames in response to the first detection signal and a vertical synchronous signal, which is input from an exterior, as the first detection signal is generated to output a counting signal;

a second detector delaying the first detection signal for a predetermined time period to output a second detection signal in response to the counting signal; and an OR logic circuit, which ORs the first detection signal and the second detection signal in order to output the detection signal.

8. The timing controller of claim 7, wherein the first detector generates the first detection signal when the second clock signal is maintained in a high level or a low level without being toggled for a predetermined time period.

9. The timing controller of claim 7, wherein the first detector generates the first detection signal when a period of the data enable signal does not match with a predetermined reference period.

10. The timing controller of claim 5, wherein the first data signal comprises a black image or a white image.

11. The timing controller of claim 5, wherein the first multiplexer outputs the first clock signal when the detection signal is generated and outputs the second clock signal when the detection signal is not generated, and the second multiplexer outputs the first data signal when the detection signal is generated and outputs the second data signal when the detection signal is not generated.

12. A method of driving a timing controller, the method comprising:

receiving an external voltage to generate a first clock signal;

outputting a detection signal based on an error in a second clock signal and a data enable signal received from an external source;

generating a first data signal corresponding to the detection signal;

selectively outputting the first clock signal or the second clock signal in response to the detection signal;

selectively outputting the first data signal or a second data signal, which is input from an external source, in response to the detection signal; and generating a data signal and a control signal in response to the first or second clock signal, and the first or second data signal, respectively.

13. The method of claim 12, wherein the outputting the detection signal comprises:

outputting a first detection signal in response to the second clock signal and the data enable signal;

counting a number of frames in response to the first detection signal and a vertical synchronous signal, which is input from an external source, as the first detection signal is generated to output a counting signal;

delaying the first detection signal for a predetermined time period to output a second detection signal in response to the counting signal; and ORing the first detection signal and the second detection signal to output the detection signal.

14. The method of claim 13, wherein the first detection signal is output when the second clock signal is maintained in a high level or a low level without being toggled for a predetermined period of time.

15. The method of claim 13, wherein the first detection signal is output when a period of the data enable signal does not match a predetermined reference period.

16. A liquid crystal display device comprising:

a liquid crystal panel displaying an image in response to a driving signal;

a timing controller receiving a first clock signal and a data enable signal from an external source in order to output a detection signal bases on an error in the first clock signal and the data enable signal, and outputting a data signal and a control signal corresponding to the detection signal while maintaining the detections signal for a predetermined time period; and a driving module outputting a driving signal in response to the data signal and the control signal to drive the liquid crystal panel, wherein the timing controller comprises:

a clock generator receiving a voltage from an external source in order to generate a second clock signal;

an error detector outputting the detection signal based on an error in the first clock signal and the data enable signal;

a data generator generating a first data signal corresponding to the detection signal;

a first multiplexer selectively outputting the first clock signal or the second clock signal in response to the detection signal;

a second multiplexer selectively outputting the first data signal or a second data signal, which is input from an external source, in response to the detection signal; and a signal generator generating the data signal and the control signal in response to signals output from the first and second multiplexers.

17. The liquid crystal display device of claim 16, wherein the clock generation module comprises a ring oscillator.

18. The liquid crystal display device of claim 16, wherein the error detector comprises:

a first detector outputting a first detection signal in response to the first clock signal and the data enable signal;

a frame counter counting a number of frames in response to the first detection signal and a vertical synchronous signal, which is input from an external source, as the first detection signal is generated to output a counting signal;

a second detector delaying the first detection signal for a predetermined time period to output a second detection signal in response to the counting signal; and an OR circuit ORing the first detection signal and the second detection signal in order to output the detection signal.

19. The liquid crystal display device of claim 18, wherein the first detector generates the first detection signal when the first clock signal is maintained in a high level or a low level without being toggled for a predetermined time period.

20. The liquid crystal display device of claim 18, wherein the first detector generates the first detection signal when a period of the data enable signal does not match with a predetermined reference period.

21. The liquid crystal display device of claim 16, wherein the first data signal comprises a black image or a white image.

22. The liquid crystal display device of claim 16, wherein the first multiplexer outputs the second clock signal when the detection signal is generated and outputs the first clock signal when the detection signal is not generated, and the second multiplexer outputs the first data signal when the detection signal is generated and outputs the second data signal when the detection signal is not generated.

* * * * *